US008807334B2

(12) United States Patent
Tsai

(10) Patent No.: US 8,807,334 B2
(45) Date of Patent: Aug. 19, 2014

(54) MULTIPLE-PURPOSE CENTERPIECE

(76) Inventor: Gary Yusun Tsai, New Taipei (TW)

( * ) Notice: Subject to any disclaimer, the term of this patent is extended or adjusted under 35 U.S.C. 154(b) by 296 days.

(21) Appl. No.: 13/506,279

(22) Filed: Apr. 10, 2012

(65) Prior Publication Data

US 2013/0264230 A1 Oct. 10, 2013

(51) Int. Cl.
*B65D 85/00* (2006.01)

(52) U.S. Cl.
USPC ..... 206/233; 206/486

(58) Field of Classification Search
USPC ..... 206/423, 223, 576, 486; 47/41.11, 47/41.01
See application file for complete search history.

(56) References Cited

U.S. PATENT DOCUMENTS 1,520,647 A * 12/1924 Hennegan ..... 47/72
3,131,511 A * 5/1964 Deaner ..... 47/41.01
D230,408 S * 2/1974 Persson-Melin ..... D11/147
4,043,077 A * 8/1977 Stonehocker ..... 47/66.1
4,958,461 A * 9/1990 Aldrich ..... 47/41.01
5,683,762 A * 11/1997 Banschick ..... 428/4
6,145,245 A * 11/2000 Honkawa et al. ..... 47/41.01
6,145,274 A * 11/2000 Weder ..... 53/399
6,523,740 B2 * 2/2003 Campbell ..... 229/114
6,568,128 B2 * 5/2003 Weder ..... 47/72
6,944,988 B2 * 9/2005 Gilbert ..... 47/41.01
7,096,623 B2 * 8/2006 Cardamone et al. ..... 47/41.01
8,069,609 B1 * 12/2011 Towne et al. ..... 47/41.12
2002/0144922 A1 * 10/2002 Olsthoorn ..... 206/423
2003/0131529 A1 * 7/2003 Weder ..... 47/72
2009/0031671 A1 * 2/2009 Temkin et al. ..... 53/397
2010/0270195 A1 * 10/2010 Ridgway et al. ..... 206/423

* cited by examiner

*Primary Examiner* — Steven A. Reynolds

(57) ABSTRACT

A multiple-purpose centerpiece includes: a container formed as a truncated cone shape slightly flared upwardly; a plurality of collapsible decorative gift stakes removably inserted in a holding base held in a lower portion of the container; and a drainage collector having a shallow recess formed in the collector and rested on a bottom of the container, whereby upon removal of all gift stakes from the container, a flower vase may be replaceably stored in the container and any water drained from the flower vase will be collected in the drainage collector. So, the container may be used continuously to thereby be environmentally friendly.

6 Claims, 4 Drawing Sheets

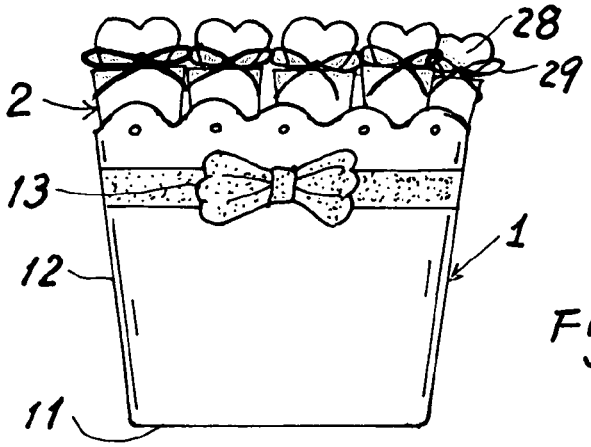
Fig. 1
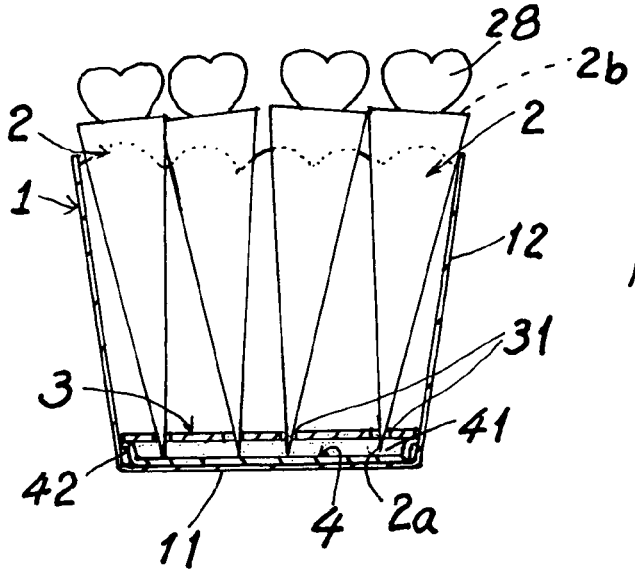
Fig. 2
Fig. 3
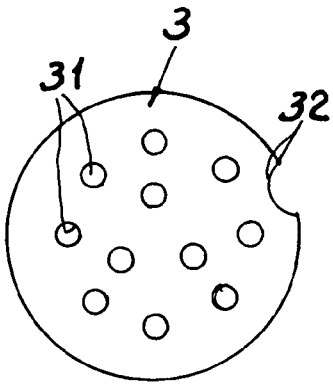
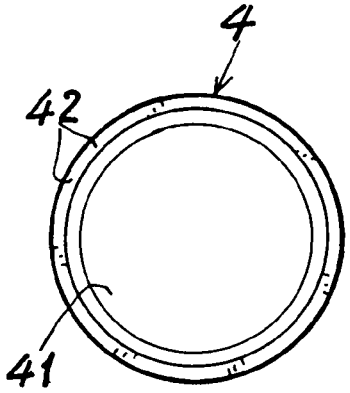
Fig. 4

MULTIPLE-PURPOSE CENTERPIECE

BACKGROUND OF THE INVENTION

U.S. Pat. No. 5,380,568 to Kenneth Banschick disclosed a centerpiece having an array of floral-like assembly elements supported on a rack to simulate a bouquet of cut flowers.

Once the floral-like elements have been removed from the tier plates of the rack, the rack with empty tier plates may reveal a poor appearance, thereby affecting a decorative effect for the centerpiece. The empty rack may become a waste and then disposed to cause environmental pollution.

Meanwhile, each element is formed as a tubular wand, which can not be collapsed or broken down to be a flat piece. So, each tubular element should be preformed such as by molding process, and can not be directly folded from a flat piece or blank, thereby increasing its production cost.

The present inventor has found the drawbacks of the prior art, and invented the present centerpiece for multiple purposes.

SUMMARY OF THE INVENTION

The object of the present invention is to provide a multiple-purpose centerpiece including: a container formed as a truncated cone shape slightly flared upwardly; a plurality of collapsible decorative gift stakes removably inserted in a holding base held in a lower portion of the container; and a drainage collector having a shallow recess formed in the collector and rested on a bottom of the container, whereby upon removal of all gift stakes from the container, a flower vase may be replaceably stored in the container and any water drained from the flower vase will be collected in the drainage collector so that the container may be used continuously, thereby being environmentally friendly.

BRIEF DESCRIPTION OF THE DRAWINGS

FIG. 1 is an illustration showing a centerpiece assembled in accordance with the present invention.

FIG. 2 is a sectional drawing of the centerpiece of the present invention.

FIG. 3 is a top view of the holding base of the present invention.

FIG. 4 is a top view of the drainage collector of the present invention.

DETAILED DESCRIPTION

Figure 5:
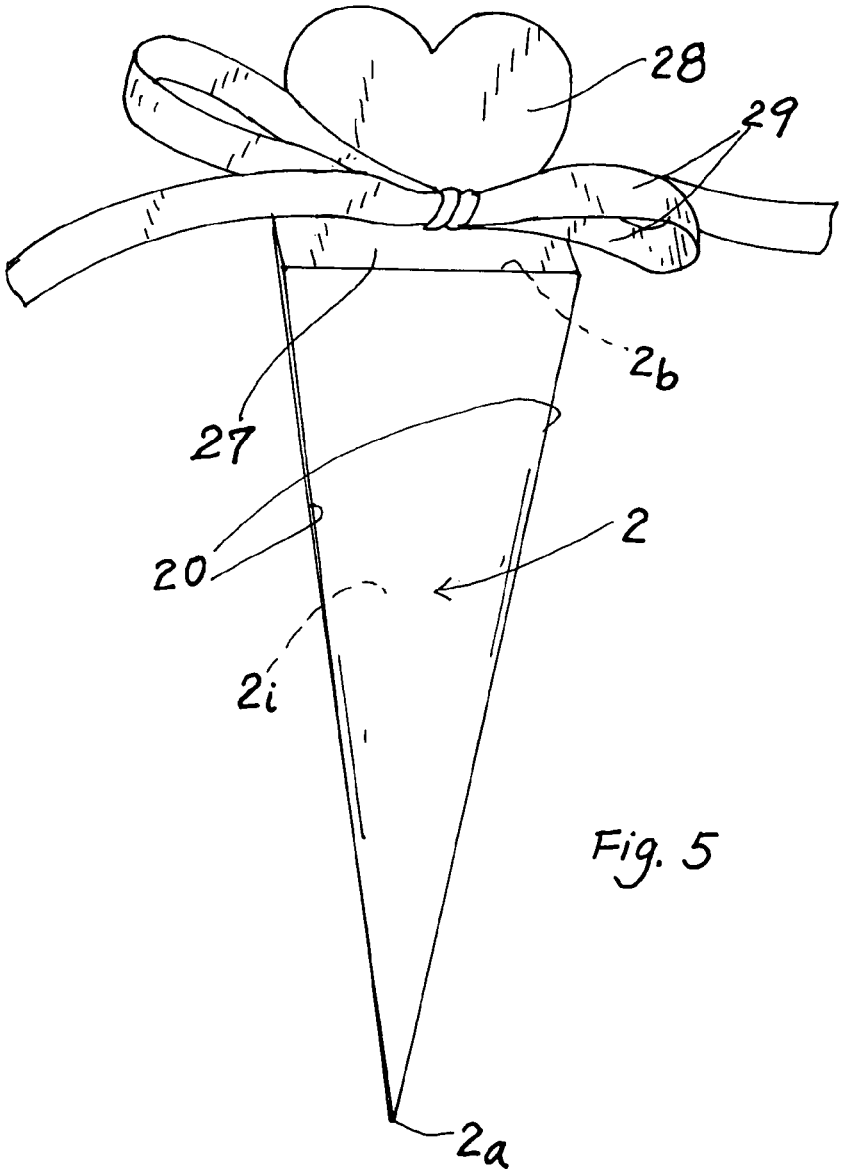
FIG. 5 is a perspective view of the collapsible decorative gift stake of the present invention.

As shown in FIGS. 1~7, the multiple-purpose centerpiece of the present invention comprises: a container 1; a plurality of collapsible decorative gift stakes 2 removably inserted in a holding base 3 held in a lower portion of the container 1; and a drainage collector 4 rested on a bottom of the container 1.

The container 1, the plural gift stakes 2 and the holding base 3 may be made of paper, paper board, or plastic materials, but not limited in the present invention.

The drainage collector 4 may be made of plastic materials, such as polyethylene or polycarbonate, preferably being transparent but not limited.

The container 1 may be formed as collapsible or foldable, which can be folded or assembled from at least one piece of flat blank, sheet or knock-down units to form a truncated cone shape slightly enlarged or flared upwardly.

Other shapes of the container 1, such as a cylindrical shape, a polygonal shape, or a bowl-like shape may also be considered, but not limited in the present invention.

The container 1 includes a bottom plate 11, a wall plate 12 circumferentially erected from the bottom plate 11 to define a storing chamber therein for holding the plurality of gift stakes 2 in the container 1, and a decorative member 13 such as a ribbon bow or knot which may be tied around the wall plate 12 of the container 1 for ornamental purpose.

The container 1 may be formed with decorative figures or designs thereon such as by directly cutting out the wall plate to obtain any desired figures or designs, or by printing any ornamental features on the wall plate.

The holding base 3 is formed with a plurality of holes 31 for inserting each gift stake 2 into each hole 31, and a notch 32 cut out in a perimeter of the base 3 for an easy embedding of the base 3 in the container 1 or easy removal of the base 3 from the container 1.

Figure 10:
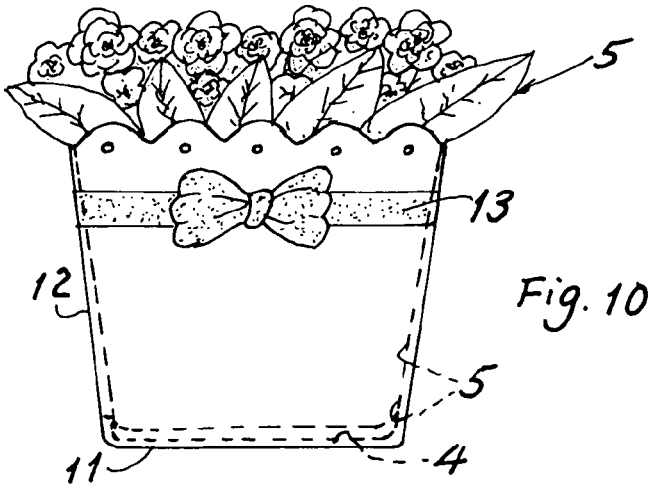
FIG. 10 is an illustration when replaceably placing a flower vase in the container of the present invention.

The drainage collector 4 includes a shallow recess 41 recessed in the collector for collecting water once drained from a flower vase or a planter 5 when placed in the container 1 (FIG. 10), and a rim 42 circumferentially formed on an upper edge of the collector 4 for supporting or resting the holding base 3 on the rim 42 of the collector 4 as shown in FIG. 2.

Figure 6:
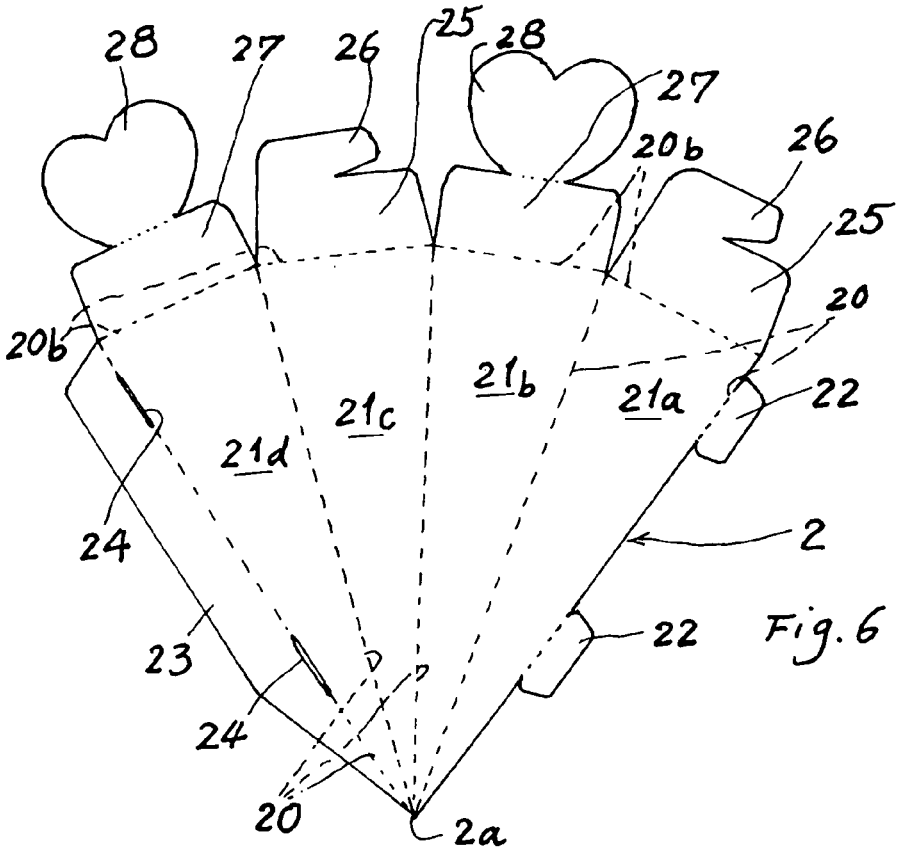
FIG. 6 shows an exploded or unfolded view of the gift stake of the present invention.
Figure 7:
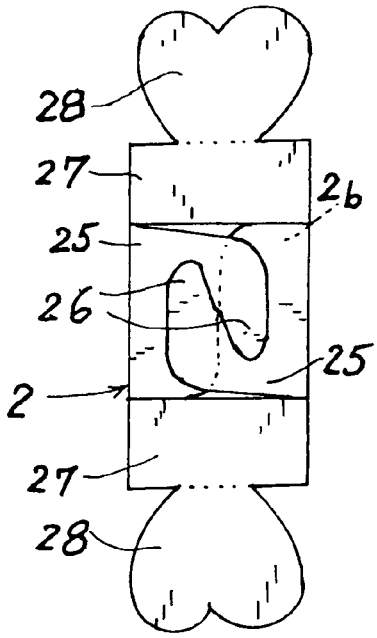
FIG. 7 is a top view illustration when folding the top portion of the gift stake.

Each collapsible decorative gift stake 2 as shown in FIGS. 5~7 includes: a first, a second, a third and a fourth triangular members 21*a*, 21*b*, 21*c* and 21*d* which are folded to be a pyramidal shape (FIG. 5) tapered downwardly from a top opening 2*b* towards a bottom tip 2*a* along a plurality of side folding lines 20; plural (or two) side tabs 22 integrally formed on a first triangular member 21*a*; plural (or two) side slits 24 formed in a side flap 23 integrally formed on a fourth triangular member 21*d* with each side tab 22 operatively engaged with each side slit 24 when bending the side flap 23 inwardly and folding the four triangular members 21*a*~21*d* to form the gift stake 2 as an inverted pyramidal shape having a bottom tip 2*a* (FIG. 5); a pair of top flaps 25, 25 oppositely formed on the top edges 20*b* of two opposite triangular members namely the first and third triangular members 21*a*, 21*c*, each top flap 25 having a top tab 26 integrally formed on each top flap 25, with two top tabs 26 operatively interlocked (FIG. 7) when inwardly folding and engaging the two top flaps 25 for closing a top opening 26 of the gift stake 2; and a pair of outer flaps 27, 27 oppositely formed on the top edges 20*b* of the other two opposite triangular members, namely the second and fourth triangular members 21*b*, 21*d*, each outer flap 27 having a decorative feature 28 (which may be a heart or floral shape, not limited) integrally formed on each outer flap 27, whereby upon inward folding of the two outer flaps 27 to be superimposed on the two top flaps 25, and upon tying the two decorative features 28 by a decorative ribbon 29, each gift stake 2 has the decorative features 28 erected upright for a nice decoration for each gift stake 2; whereby upon folding of the four triangular members 21*a*~21*d* to form a pyramidal shape, a pyramidal interior 2*i* is defined within the four triangular members for storing candy, miniature gift items, or any other small objects in the pyramidal interior 2*i*.

Accordingly, the centerpiece of the present invention may be placed in a table of a party or banquet for decorative purpose normally, and the gift stakes 2 may then be taken by or distributed to the guest who join the party or banquet. The centerpiece may play roles for decoration purpose and also for distributing gifts to the guest.

Once all the gift stakes 2 are removed from the centerpiece, the container 1 may be replaceably stored with a flower vase or planter 5 therein for further decoration purpose. The base 3 may be removed or not. The water as drained from the vase 5 will be collected by the drainage collector 4 held in the bottom of the container 1.

So, the container 1 may be "re-used" or continuously used without being disposed as a waste, thereby being environmentally friendly.

Figure 8:
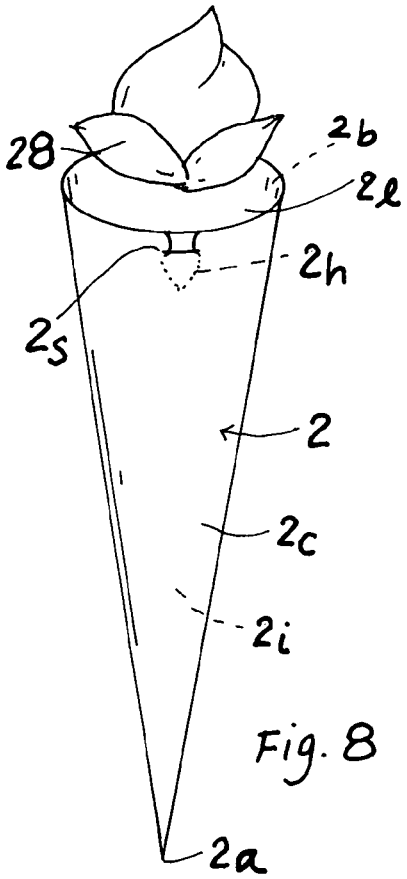
FIG. 8 shows another preferred embodiment of the gift stake of the present invention.
Figure 9:
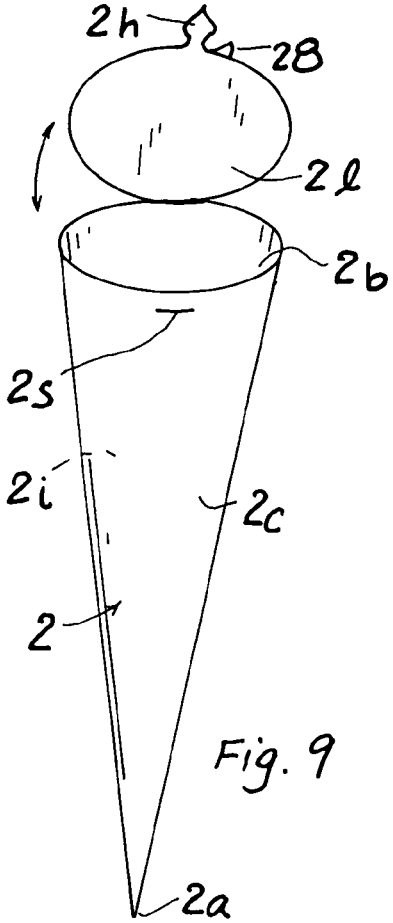
FIG. 9 shows the gift stake as uncovered from FIG. 8.

As shown in FIGS. 8 and 9, each gift stake 2 may be modified to be a conical shape, which may be folded from a flat piece or a breakdown blank (not shown).

Each gift stake 2 as shown in FIGS. 8 and 9 includes: a conical box 2*c* tapered downwardly towards a bottom tip 2*a* to define a conical interior 2*i* in the conical box 2*c* for storing candy or miniature gifts or items therein, a top cover 2*l* integrally formed or releasably formed on a top of the conical box 2*c* for covering a top opening 2*b* of the conical box 2*c*, and at least a decorative feature 28 formed on the top cover 2*l* for decorative purpose.

The top cover 2*l* includes a latch member 2*h* operatively locked or engaged with a top slit 2*s* formed in a top portion of the conical box 2*c* for closing the top cover 2*l* on the top opening 2*b* of the conical box 2*c*.

The conical gift stake 2 as shown in FIG. 8 may be unfolded to be a flat piece which may be pre-formed in order that once being folded or assembled, a conical-shape gift stake 2 is formed to substitute the pyramidal-shape gift stake 2 as aforementioned or as shown in FIGS. 5 and 6.

The present invention may be modified without departing from the spirit and scope of the present invention.

I claim:

1. A multiple-purpose centerpiece comprising:

a container;

a plurality of collapsible decorative gift stakes removably inserted in a holding base held in a lower portion of said container, each said collapsible decorative gift stake including: a first, a second, a third and a fourth triangular member or four triangular members which are folded to be a pyramidal shape tapered downwardly from a top opening towards a bottom tip along a plurality of side folding lines; a plurality of side tabs integrally formed on said first triangular member; a plurality of side slits formed in a side flap integrally formed on said fourth triangular member, with each said side tab operatively engaged with each said side slit when bending the side flap inwardly and folding the four triangular members to form the gift stake as an inverted pyramidal shape having a bottom tip; a pair of top flaps oppositely formed on two top edges of two opposite triangular members including the first and third triangular members, each said top flap having a top tab integrally formed on each top flap, with two said top tabs operatively interlocked when inwardly folding and engaging the two said top flaps for closing a top opening of the gift stake; and a pair of outer flaps oppositely formed on two top edges of the other two opposite triangular members, including the second and fourth triangular members, each said outer flap having a decorative feature integrally formed on each said outer flame, whereby upon inward folding of the two outer flaps to be superimposed on the two top flaps, and upon tying the two decorative features by a decorative ribbon, each said gift stake has the decorative features erected upright for a decoration for each said gift stake; whereby upon folding of the four triangular members to form a pyramidal shape, a pyramidal interior is defined within the four triangular members for storing candy, miniature gift items, or small objects in the pyramidal interior; and a drainage collector rested on a bottom of said container and positioned under said holding base;

whereby upon removal of all said gift stakes from said container, a flower vase or planter is replaceably placed in said container, and upon drainage of water from said vase or planter, the water is collected by said drainage collector.

2. A centerpiece according to claim 1, wherein said container includes a bottom plate, and a wall plate circumferentially erected from said bottom plate and defining a storing chamber therein for holding said plurality of gift stakes in said storing chamber.

3. A centerpiece according to claim 1, wherein said holding base includes a plurality of holes formed through said holding base for removably inserting each said gift stake in each said hole for holding said gift stakes in said container.

4. A centerpiece according to claim 1, wherein said drainage collector includes a shallow recess formed in said collector for collecting water as drained from a flower vase or planter when placed in said container.

5. A centerpiece according to claim 1, wherein said drainage collector includes a rim circumferentially formed on an upper edge of said collector for supporting or resting said holding base on said rim of said collector.

6. A centerpiece according to claim 1, wherein said container is formed as an inverted truncated cone shape slightly flared upwardly, and having a decorative member tied around or formed on said container for decoration.

* * * * *